US006869176B2

(12) United States Patent
Saito

(10) Patent No.: US 6,869,176 B2
(45) Date of Patent: Mar. 22, 2005

(54) RECORDING APPARATUS, AND RECORDING MEDIUM FLOATING PREVENTION MEMBER

(75) Inventor: Hiroyuki Saito, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/234,156

(22) Filed: Sep. 5, 2002

(65) Prior Publication Data

US 2003/0052930 A1 Mar. 20, 2003

(30) Foreign Application Priority Data

Sep. 7, 2001 (JP) ..... 2001-272246

(51) Int. Cl.[7] ..... B41J 2/145; B41J 2/15; B41J 2/21; B41J 2/01; B41J 13/10

(52) U.S. Cl. ..... 347/104; 347/40; 347/43; 347/101; 347/105; 347/218; 347/219; 400/624; 400/105; 400/642; 400/645

(58) Field of Search ..... 347/104, 40, 43, 347/101; 400/642, 645

(56) References Cited

U.S. PATENT DOCUMENTS

| | | | | |
|---|---|---|---|---|
| 5,455,610 A | * | 10/1995 | Harrington | 347/43 |
| 5,480,247 A | | 1/1996 | Saikawa et al. | |
| 5,646,667 A | * | 7/1997 | Broder et al. | 347/104 |
| 5,673,074 A | | 9/1997 | Miyauchi et al. | |
| 5,903,290 A | | 5/1999 | Nicoloff, Jr. et al. | |
| 6,086,185 A | * | 7/2000 | Inui et al. | 347/43 |
| 6,092,892 A | | 7/2000 | Taniguro et al. | |
| 6,139,140 A | * | 10/2000 | Rasmussen et al. | 347/104 |
| 6,260,947 B1 | | 7/2001 | Pinkernell | |
| 6,270,215 B1 | | 8/2001 | Miyasaka et al. | |
| 6,293,670 B1 | | 9/2001 | Taniguro et al. | |
| 6,318,854 B1 | * | 11/2001 | Rasmussen et al. | 347/104 |

FOREIGN PATENT DOCUMENTS

| | | | | |
|---|---|---|---|---|
| EP | 0 862 314 | | 9/1998 | |
| EP | 1 053 883 | | 11/2000 | |
| EP | 1186993 A2 | * | 3/2002 | G06F/3/12 |
| EP | 1234676 A2 | * | 8/2002 | B41J/2/21 |
| JP | 2001347692 A | * | 12/2001 | B41J/2/18 |
| JP | 2002036649 A | * | 2/2002 | B41J/13/10 |

* cited by examiner

*Primary Examiner*—Stephen D. Meier
*Assistant Examiner*—Leonard Liang
(74) *Attorney, Agent, or Firm*—Fitzpatrick, Cella, Harper & Scinto

(57) ABSTRACT

A recording apparatus is equipped with a recording head for performing recording on a conveyed recording medium by discharging liquid from a discharge opening array, and comprises a conveyor for conveying the recording medium, and a recording medium floating prevention member for preventing floating of the recording medium, wherein the floating prevention member includes a floating prevention area between the recording medium and the recording head, only on an upstream side, in the conveyance direction of the recording medium, of the discharge opening array of the recording head used in non-margin recording of performing the recording throughout the width of the recording medium. Thus, collision of the recording medium and the recording head can be prevented in both margin recording and the non-margin recording, without lowering recording speed and deteriorating recording quality.

17 Claims, 8 Drawing Sheets

RECORDING APPARATUS, AND RECORDING MEDIUM FLOATING PREVENTION MEMBER

BACKGROUND OF THE INVENTION

1. Field of the Invention

The present invention relates a recording apparatus which records an image on a recording medium, and more particularly, to a recording apparatus which records an image on a recording medium by discharging liquid from a recording head apart from the recording medium.

2. Related Background Art

Conventionally, in a serial ink-jet printer acting as one of serial-type recording apparatuses, a recording sheet being a recording medium is conveyed by an optimum amount on a platen of supporting the recording sheet by a conveyance roller acting as a conveyance means and a pinch roller rotatively driven according to the conveyance roller. Moreover, a recording head acting as a recording means positioned apart from the recording sheet and for discharging liquid ink to the recording sheet is mounted on a carriage acting as a carrier means of the recording head, and an image is recorded on the recording sheet by discharging the liquid ink from at least one discharge opening array (i.e., a nozzle array) of the recording head while scanning the carriage in the direction (main scan direction) intersecting the conveyance direction of the recording sheet. Under the condition that it is demanded to record a high-quality image, recently, an interspace (hereinafter, called a sheet space) between the recording head and the recording sheet becomes narrow. This is because,. by narrowing the sheet space, it aims to shorten the distance and time until an ink droplet discharged from the recording head is impacted and to minimize a dislocation amount between the ink droplet impact position and a target position.

However, as the sheet space is made narrower, it is highly possible that the recording head collides with the recording sheet when the motion of the recording sheet becomes unstable, the ink adhered on the face of the recording head is thus transferred to the recording sheet and therefore the image quality on the recording sheet is deteriorated. Moreover, it is highly possible that the recording sheet is caught by the recording head and the carriage on scanning and thus it is damaged. Also, it is possible that the recording head collided with the recording sheet is damaged and thus normal recording becomes unguaranteed.

In the above ink-jet printer, especially the right and left ends of the recording sheet easily float, whereby there is a high possibility that these ends collide with the recording head. Moreover, in the structure of the serial-type recording apparatus, the motion of the recording sheet is relatively stable while the recording sheet is being pressed and conveyed between the pinch roller positioned on the upstream side of the recording head in the conveyance direction and a spur positioned on the downstream side thereof. However, when the recording is performed on the leading and trailing ends of the recording sheet in the conveyance direction, it is difficult to hold down both the leading and trailing ends of the recording sheet on the upstream and downstream sides of the recording head, whereby there is a high possibility that the recording sheet floats and thus collides with the recording head.

In the ink-jet printer, to prevent the collision of the recording head and the recording sheet, various countermeasures have been considered so far. First, areas other than the area where the image is to be recorded at the right and left ends of the recording sheet, i.e., margins not including the recording area on the recording sheet, were addressed. Thus, a plate member (i.e., a recording sheet floating prevention member) of which the length is equal to or longer than the length of a nozzle array acting as the ink droplet discharge opening array of the recording head, is arranged at the position corresponding to the margin on carriage scanning when the recording sheet is conveyed to the position opposite to the nozzle array, thereby preventing the floating of the side ends of the recording sheet.

On one hand, with respect to the recording to be performed on the leading end of the recording sheet, the rotation axis of the pinch roller is disposed closer to the side of the recording head (on the downstream side of the recording sheet in the conveyance direction) than the rotation axis of the conveyance roller so that the leading end of the recording sheet is pressed against a platen by the pinch roller, thereby preventing the floating of the recording sheet. Moreover, with respect to the recording to be performed on the trailing end of the recording sheet, the rotation axis of the spur rotating according to a sheet discharge roller is disposed closer to the side of the recording head (on the upstream side of the recording sheet in the conveyance direction) than the rotation axis of the sheet discharge roller, or the height of the sheet discharge roller on the downstream side is made higher in a case where the two lines of discharge rollers are provided, so that the trailing end of the recording sheet is pressed against the platen, thereby preventing the floating of the recording sheet. Moreover, the height of a sheet discharge tray is made higher by an optimum amount to prevent the sheet from hanging down, thereby preventing the floating of the recording sheet within the recording area from the sheet discharge roller as a starting point.

In the above countermeasure to prevent the floating of the leading end of the recording medium in the conventional ink-jet printer, a recording medium floating prevention effect is great because the pressing force of the pinch roller to the platen is large. However, the trailing end of the recording medium easily floats because the pressing force to the platen is small. For this reason, if the side ends of the recording medium, particularly the side ends on the upstream side in the conveyance direction, are not pressed by the floating prevention member, there is a problem that a possibility that the trailing end of the recording medium after having passed the pinch roller and being most far from the spur and the discharge roller on the downstream side in the conveyance direction collides with the recording head, becomes higher.

On the other hand, when so-called non-margin recording to perform the recoding throughout the recording sheet is performed, the side ends of the recording sheet are used as the recording area, whereby it is difficult to provide the recording sheet floating prevention member on the margin outside the recording area on the carriage scanning. As a result, there is a problem that the recording sheet easily collides with the recording head.

SUMMARY OF THE INVENTION

An object of the present invention is to provide a recording apparatus which can prevent collision of a recording medium and a recording head in both margin recording and non-margin recording, without lowering a recording speed and deteriorating recording quality.

Another object of the present invention is to provide a recording apparatus which can be equipped with a recording means for performing recording on a conveyed recording medium by discharging liquid from a discharge opening array, comprising: a conveyance means for conveying the recording medium; and a recording medium floating prevention member for preventing floating of the recording medium, wherein the floating prevention member includes a floating prevention area between the recording medium and the recording means, only on an upstream side, in the conveyance direction of the recording medium, of the discharge opening array of the recording means used in the non-margin recording of performing the recording throughout the width of the recording medium.

DETAILED DESCRIPTION OF THE PREFERRED EMBODIMENTS

Hereinafter, a recording apparatus according to the embodiment of the present invention will be explained in detail with reference to the attached drawings. In the specification, it is assumed that "recording" includes not only a case where significant information such as characters, figures and the like is formed, but also a case where images, designs, patterns and the like are widely formed on a recording medium or the recording medium is processed, irrespective of significant information or insignificant information and irrespective of whether or not the information is visualized so that it can be visually perceived by a human being. Moreover, it is assumed that a "recording sheet" (also called the recording medium) widely includes not only paper used in a general recording apparatus, but also cloth, plastic, a film, a metallic board or the like, a glass, ceramics, wood, leather or the like, and matter capable of receiving ink.

Moreover, like the above definition of the "recording", "ink" (also called liquid) should be widely interpreted. That is, it is assumed that the "ink" includes liquid which can be used in the forming of the images, the designs, the patterns and the like, the process of the recording medium, or a process of the ink (e.g., coagulation or insolubilization of color materials included in the ink to be applied to the recording medium), by applying it to the recording medium.

(First Embodiment)

Figure 1:
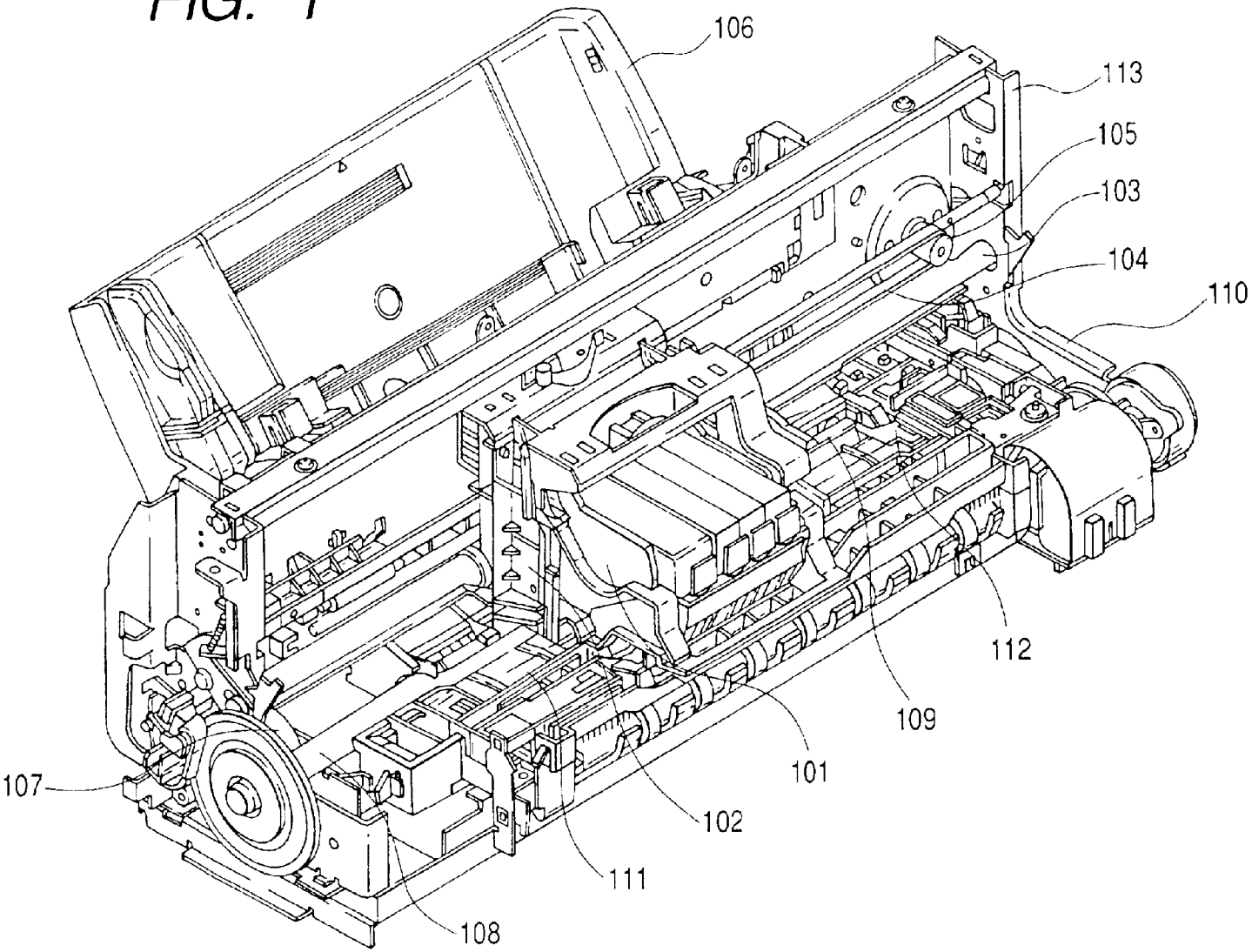
FIG. 1 is a perspective view showing the overall structure of a recording apparatus according to a first embodiment of the present invention.
Figure 2:
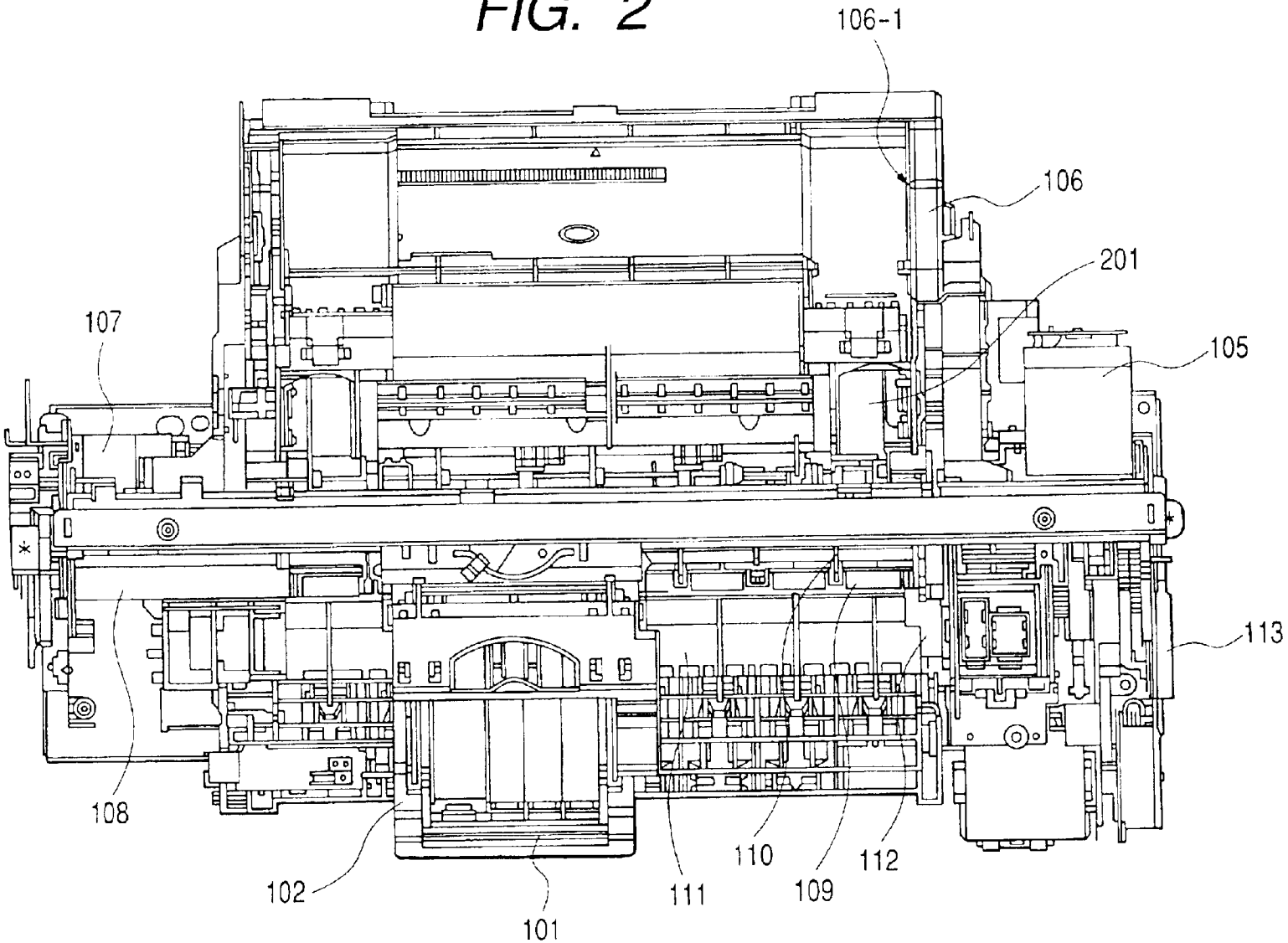
FIG. 2 is an elevation view showing the overall structure of the recording apparatus according to the first embodiment of the present invention.

First, the recording apparatus according to a first embodiment of the present invention will be explained. FIG. 1 is a perspective view showing the overall structure of the recording apparatus according to the present embodiment, and FIG. 2 is an elevation view showing the overall structure of the recording apparatus according to the present embodiment. Here, it is assumed that the recording apparatus according to the present embodiment is a serial-type ink-jet printer which is equipped with a recording head to which an ink tank is detachably mounted.

In FIGS. 1 and 2, numeral 101 denotes the recording head on which the ink tank is mounted, and numeral 102 denotes a carriage on which the recording head 101 is mounted. A guide shaft 103 is inserted into a bearing unit (not shown) of the carriage 102 so that the carriage 102 is slidable in a main scan direction, and both ends of the guide shaft 103 are fixed to a chassis 113. Here, a driving force of a driving motor 105 acting as a carriage driving means is transmitted to the carriage 102 through a belt 104 engaged with the carriage 102 and acting as a carriage driving transmission means, whereby the carriage 102 becomes slidable in the main scan direction.

Recording sheets (not shown in FIGS. 1 and 2) are stacked on a sheet feed base 106 in a recording waiting state, and the stacked recording sheets are fed by a sheet feed roller 201 when the recording starts. By a conveyance roller 108 rotatively driven by a conveyance motor 107 and a pinch roller 109 pressed against the conveyance roller 108 by a pinch roller spring 110 and thus rotated according to the conveyance roller 108, the fed recording sheet is conveyed by an appropriate amount. Then, while the carriage 102 is scanning, ink is discharged from the recording head 101 to the recording sheet pressed against a platen 111, whereby an image is recorded on the recording sheet. After the image recording ends, the recording sheet is discharged by a sheet discharge means (not shown in FIGS. 1 and 2), whereby the recording operation is completed. Incidentally, since the recording sheets are set on the sheet feed base 106 taking a right end 106-1 as a reference side shown in FIG. 2, even if the recording sheets respectively having different widths are supplied and set-at random, the positions of the right ends of these sheets are unchanged. Numeral 112 denotes a recording sheet floating prevention member (or a recording medium floating prevention member) which holds down floating of the end of the recording sheet just being conveyed, and this member is attached to the platen 111.

Figure 3:
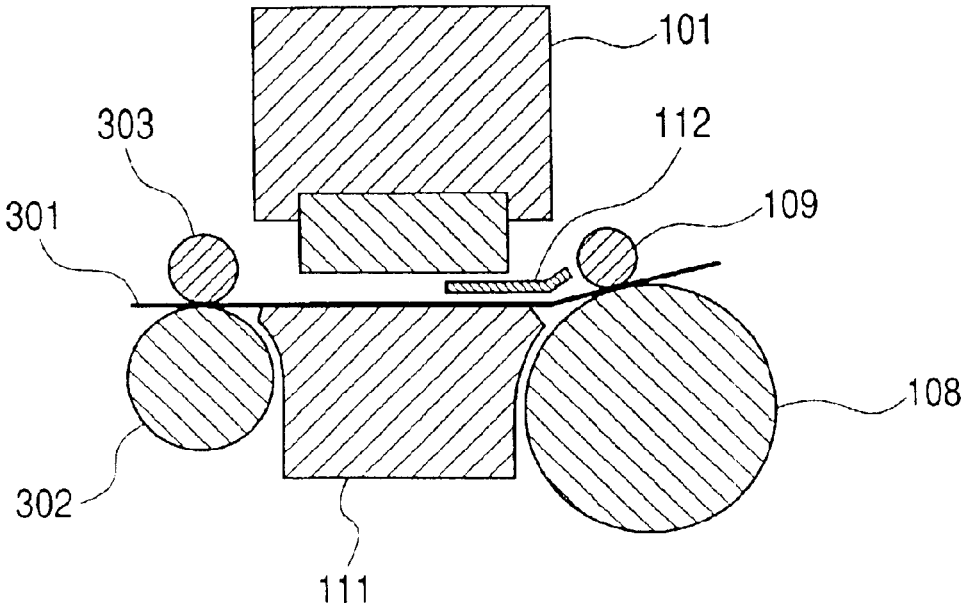
FIG. 3 is a schematic section view showing the structure of a recording head, a platen and the periphery thereof in the recording apparatus according to the first embodiment of the present invention.

FIG. 3 is a schematic section view showing the structure of the recording head 101, the platen 111 and the periphery thereof in the recording apparatus according to the present embodiment. As shown in FIG. 3, the recording sheet floating prevention member 112 is arranged between a recording sheet 301 on the platen 111 and the recording head 101 so as to prevent the recording sheet 301 from coming into contact with the recording head 101. Moreover, the recording sheet 301 conveyed by the pinch roller 109 and the conveyance roller 108 is nipped between a sheet discharge roller 302 acting as the sheet discharge means and a spur 303 on the downstream side in a conveyance direction P (see FIG. 4).

Figure 4:
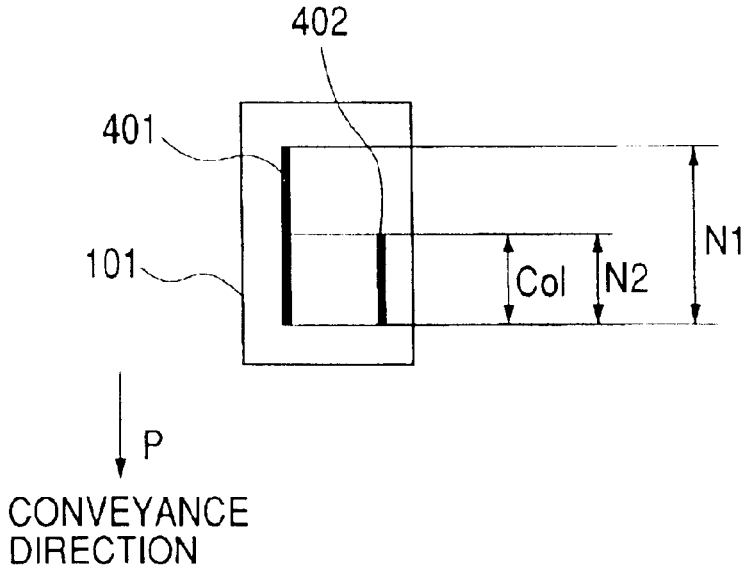
FIG. 4 is an elevation view showing the face of the recording head where discharge opening arrays are disposed, in the recording apparatus according to the first embodiment of the present invention.

FIG. 4 is an elevation view showing a face of the recording head 101 where discharge opening arrays are disposed, in the recording apparatus according to the present embodiment. In FIG. 4, numeral 401 denotes a nozzle array which discharges black ink droplets, and numeral 402 denotes a nozzle array which discharges color ink droplets. Although the nozzle array 402 actually consists of plural nozzle arrays respectively discharging cyan, magenta and yellow ink droplets, FIG. 4 illustrates these plural nozzle arrays as a one-line nozzle array for simplification in explanation.

In a case where a printer is ordinarily used, since the recording by the black ink generally implies text recording, high recording speed is demanded. Thus, it is desired that the nozzle array 401 is as long as possible in the conveyance direction P of the recording sheet 301. Besides, in a case where high-quality nonmargin recording (such as photograph recording) is performed, the recording is performed mainly by the color inks. Therefore, the nozzle array 401 (length N1) is set to be longer than the nozzle array 402 (length Col), and the nozzle array 402 is arranged on the downstream side, in the conveyance direction P of the recording sheet, of the position where the recording sheet floating prevention member 112 is arranged. By arranging the nozzle arrays 401 and 402 on the discharge opening face as described above, a first area where the nozzle array 401 is arranged and the length of the recording sheet in the conveyance direction P is N1 and a second area where both the nozzle arrays 401 and 402 are arranged and the length of the recording sheet in the conveyance direction P is N2, are formed on the discharge opening face.

In the recording apparatus according to the present embodiment, the nozzle array in the first area is used as a margin recording nozzle array for margin recording, in which the recording is performed with the margins remaining on the side ends of the recording sheet, and the nozzle arrays in the second area are used as a non-margin recording nozzle array for non-margin recording, in which the recording is performed up to the side ends of the recording sheet, i.e., throughout the width of the recording sheet. Therefore, in the recording apparatus according to the present embodiment, all the nozzles of the nozzle array 401 to discharge the black ink comprises the margin recording nozzle array, the second area is included in the first area, and the non-margin recording discharge opening array is included in the margin recording discharge opening array.

The second area is arranged on the downstream side of the first area in the conveyance direction P of the recording sheet, and there are various meanings to arrange the nozzle array 401 on the upstream side of the nozzle array 402 in the conveyance direction P of the recording sheet. For example, line feed in recording can be shifted so that the color inks are recorded after the precedingly recorded black ink dries to some extent, whereby a blur on the boundary between the black ink recording and the color ink recording and a density deterioration due to the drawn ink can be reduced. Therefore, in the recording head 101 of the recording apparatus according to the present embodiment, it is desirable to set $N1-N2 \geqq Col$ and to be able to perform the black-ink recording by the line feed before the color-ink recording is performed. Incidentally, in a case where the recording apparatus using both the nozzle array 401 to discharge the black ink and the nozzle array 402 to discharge the color inks only in a high quality mode of forming an image by plural scans is used, even if $N1-N2<Col$, the above effect of reducing the blur and the density deterioration might be achieved.

Figure 5:
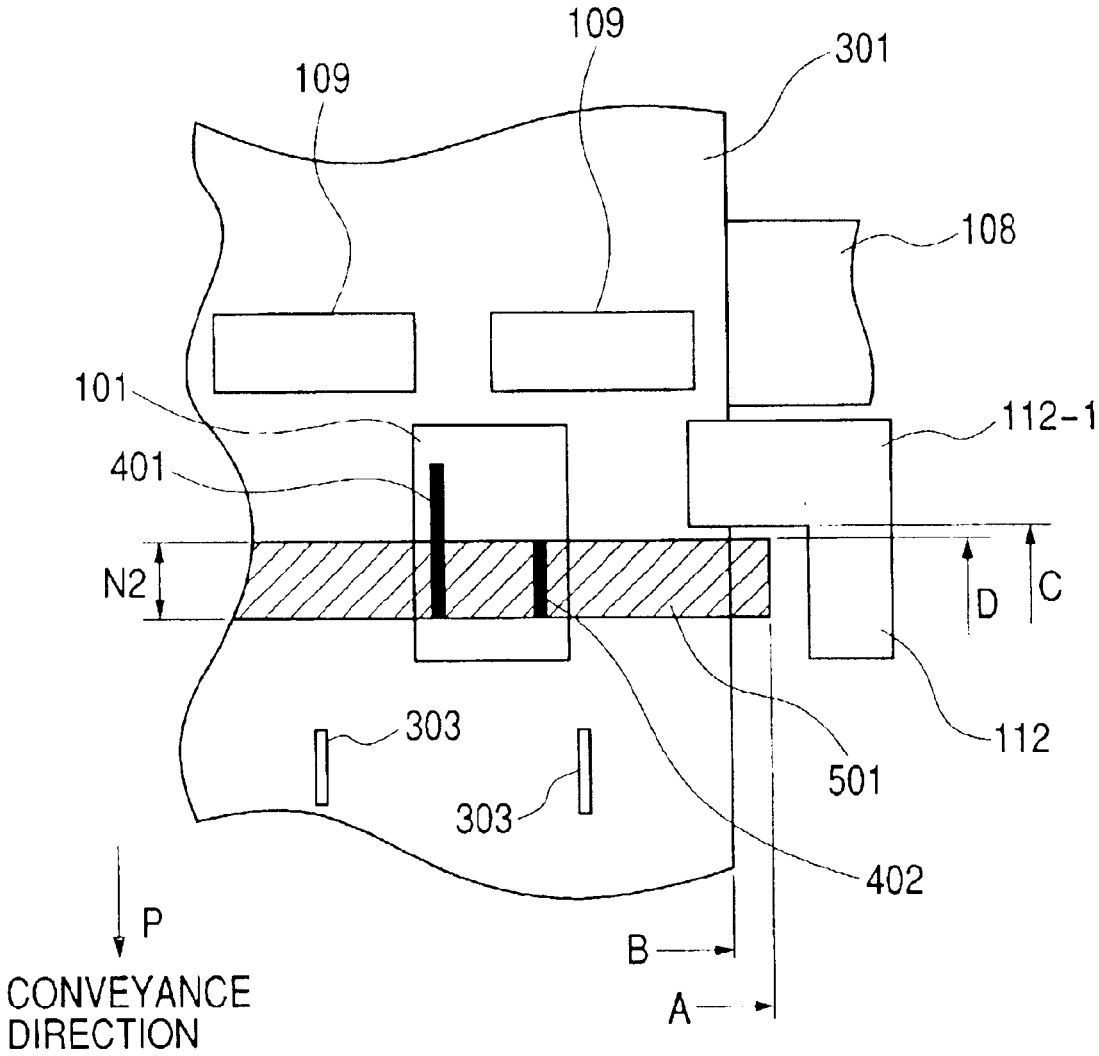
FIG. 5 is a view showing the relation of a recording area and a sheet floating prevention member with respect to nozzle arrays.
Figure 6:
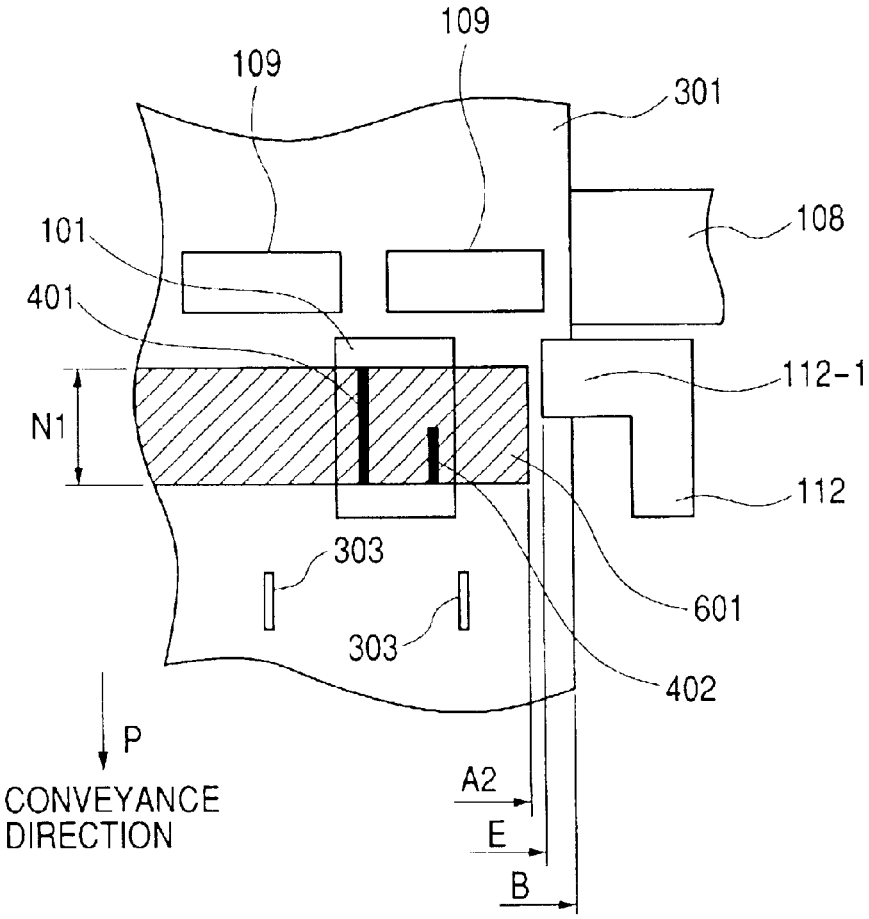
FIG. 6 is a view showing the relation of the recording area and the sheet floating prevention member with respect to the nozzle arrays.

FIGS. 5 and 6 are views showing the relation of the recording area and the recording sheet floating prevention member 112 with respect to the nozzle arrays 401 and 402. In FIG. 5, numeral 112-1 denotes a recording sheet floating prevention area of the recording sheet floating prevention member 112, and numeral 501 denotes a recording area on which an image can be recorded by the non-margin recording nozzle array in the second area of the recording head 101. In order to enable the recording up to the side ends of the recording sheet, an endmost position A in the carriage scan direction of the recording area 501 is set at the position identical with a recording sheet end B or outside the recording sheet 301. Moreover, the recording sheet floating prevention area 112-1 is arranged in the recording sheet conveyance direction not to overlap the recording area 501.

With respect to the nozzle array 401 shown in FIG. 4, it is assumed that the ink can be discharged from the overall nozzle arrays in the first area when the margin recording is performed. On the other hand, the nozzle arrays to discharge the ink can be limited when the non-margin recoding is performed, that is, it is assumed that in this case the ink can be discharged only from the nozzle array in the second area. However, as already described, for example, if the black ink is incompatible to a recording sheet to be used because the black ink is a pigmented ink or the like, it is possible not to use the black ink but to reproduce the black by overlaying the color inks. In this case, as shown in FIG. 4, the length N2 of the non-margin recording nozzle array in the conveyance direction P is set to be the same as the length Col of the nozzle array 402. Moreover, in FIG. 4, although the downstream end posit-ion of the nozzle array 401 conforms to the downstream end position of the nozzle array 402 in the conveyance direction P, these positions need not necessarily conform. That is, the downstream end of the nozzle array 401 may be positioned on the further downstream side of the downstream end of the nozzle array 402. Moreover, if the black ink is not used when the non-margin recording is performed, the downstream end of the nozzle array 401 may be positioned on the upstream side of the downstream end of the nozzle array 402.

In the recording apparatus according to the present embodiment, the recording sheet floating prevention area 112-1 where the recording sheet floating prevention member 112 and the recording sheet 301 overlap is arranged on the upstream side, in the conveyance direction P, of the non-margin recording nozzle array in the second area, whereby the floating of the recording sheet 301 is held down. By providing the recording sheet floating prevention area 112-1 as above, particularly, it is possible to hold down the floating of the recording sheet 301 immediately after having passed the pinch roller 109. This is because the floating prevention effect for the recording sheet 301 after having passed the pinch roller 109 by means of the downstream spur 303 decreases as the distance from the spur 303 to the floating increases, and the floating at the trailing end of the recording sheet directly after having passed the pinch roller 109 is the most extreme.

As shown in FIG. 5, in order to widen the recording sheet floating prevention area 112-1 as much as possible to improve the floating prevention effect during the recording sheet conveyance, it is desirable to arrange a downstream end position C of the recording sheet floating prevention area 112-1 so that the position C comes as close as possible to a most upstream position D of the non-margin recording nozzle array.

In the recording apparatus according to the present embodiment, although the recording sheet floating prevention member 112 and the recording sheet overlap on the upstream side of the recording area 501, the recording sheet floating prevention member 112 and the recording sheet do not overlap, in the recording area 501 and on the downstream side thereof, and thus the recording sheet floating prevention member 112 does not come into contact with the area of the recording sheet where the recording has already ended, whereby it is possible to prevent the image quality deterioration after the recording.

In FIG. 6, numeral 601 denotes a recording area where the image can be recorded by the margin recording nozzle array of the recording head 101. The recording sheet floating prevention area 112-1 is arranged at the position substantially the same as that of the nozzle array used in the margin recording in the conveyance direction P of the recording sheet 301, and outside the recording area 601 of the nozzle array used in the margin recording in the carriage scan direction. An end E on the recording sheet side of the recording sheet floating prevention area 112-1 is arranged outside an end A2 of the recording area 601 and inside the side end B of the recording sheet 301. That is, only the margin area of the recording sheet 301 overlaps the recording sheet floating prevention member 112, and this member is not in contact with the recording area 601, whereby it is possible to surely hold down the floating of the recording sheet 301 and to prevent the image quality deterioration after the recording.

As described above, in the recording apparatus according to the present embodiment, the floating of the recording sheet 301 on the upstream side of the non-margin recording area 501 is held down by the recording sheet floating prevention member 112, whereby the non-margin recording can be achieved. Moreover, the length of the margin recording nozzle array is elongated in the conveyance direction P, whereby the collision of the recording sheet 301 and the recording head 101 can be prevented while maintaining nozzle use efficiency (speed) in the margin recording.

Moreover, if the recording sheet floating prevention member 112 is constructed by attaching the plate member to the platen 111, the dimension in height can be easily controlled, and the height clearance between the recording head 101 and the recording sheet floating prevention member 112 can be easily secured. However, the recording sheet floating prevention member 112 is not limited to that attached to the platen 11, that is, it may be attached to the member for holding the pinch roller 109 or the member for holding the spur 303 or may be integrated into the platen 111 or the above members for a further cost advantage. If the recording sheet floating prevention member 112 is integrated into the platen 111, the number of parts of the recording sheet floating prevention member 112, its mounting member and the like can be reduced.

Figure 7:
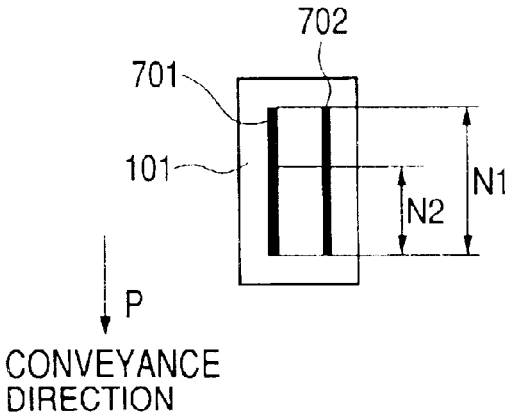
FIG. 7 is a view of a face of the recording head where the discharge opening arrays are disposed.

Moreover, in the recording apparatus according to the present embodiment, when the black ink is used, the nozzle area to be used is changed between the non-margin recording and the margin recording. However, in the recording head 101 shown in FIG. 7, like a nozzle array 701 to discharge the black ink, a nozzle array 702 to discharge the color inks can be used so as to use the overall first nozzle area of the length N1 in the margin recording and to limit the use of the nozzle array only to the nozzle array in the second area of the length N2 in the non-margin recording.

Figure 8:
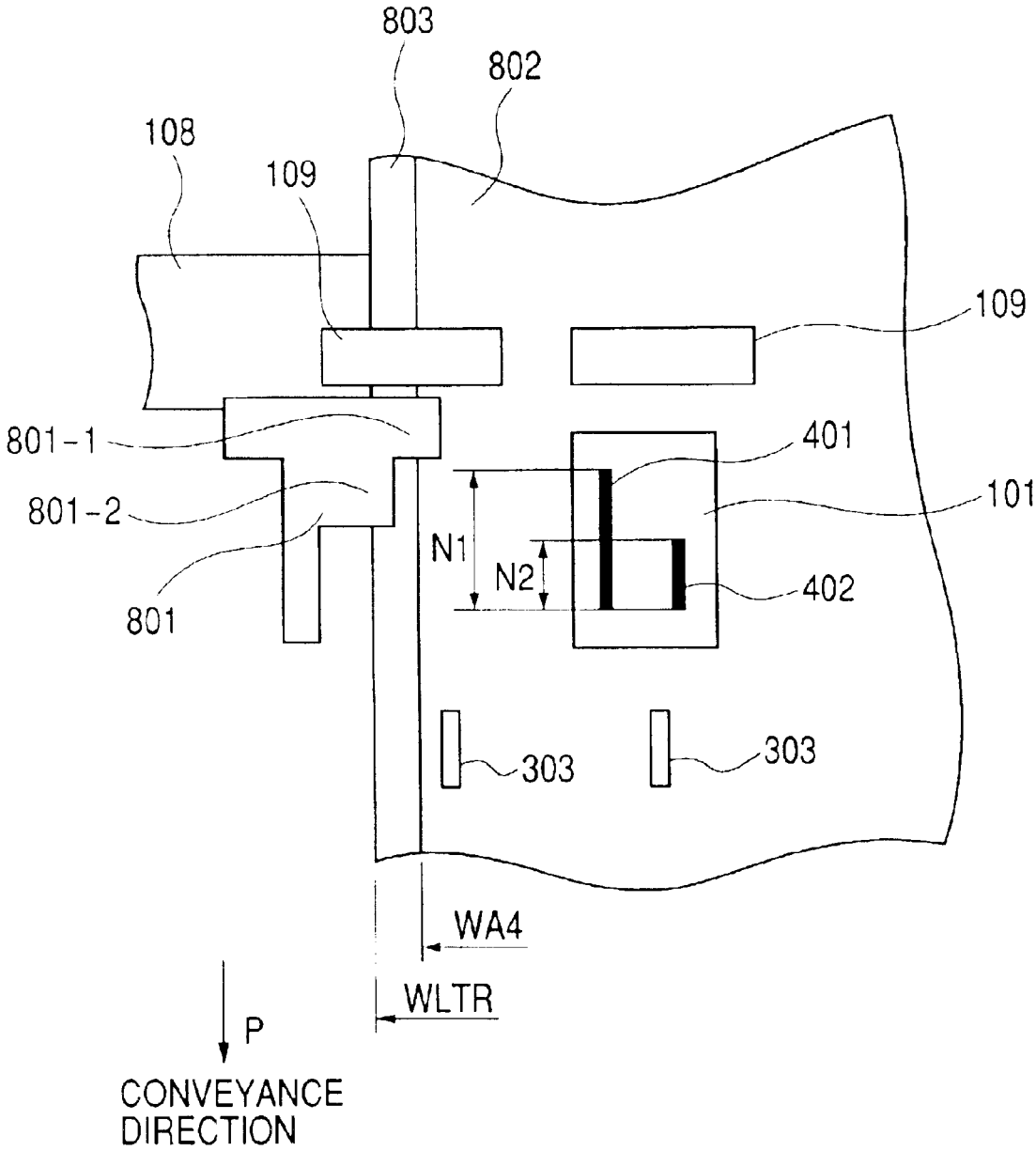
FIG. 8 is a view showing the relation of a recording area on the side not based on a recording sheet and the sheet floating prevention member.

Incidentally, the shape of the recording sheet floating prevention member 112 on the reference side of the recording sheet has been described as above. Hereinafter, the recording sheet floating prevention member on a non-reference side of the recording sheet will be explained. FIG. 8 is a view showing the relation of the recording area on the non-reference side of the recording sheet and the recording sheet floating prevention member. In FIG. 8, numeral 802 denotes a letter-size recording sheet, numeral 803 denotes an A4-size recording sheet with high use frequency, symbol WA4 denotes a side end position of the A4-size recording sheet, and symbol WLTR denotes a side end position of the letter-size recording sheet.

As shown in FIG. 8, like the recording sheet floating prevention member 112 on the reference side of the recording sheet, a recording sheet floating prevention member 801 on the non-reference side of the recording sheet has the shape not overlapping the recording area in the non-margin recording, and includes a recording sheet floating prevention area 801-1 to prevent the floating of the A4-size recording sheet and a recording sheet floating prevention area 801-2 to prevent the floating of the letter-size recording sheet. The end position of the recording sheet floating prevention area 801-1 is set inside the side end position WA4 of the A4-size recording sheet, and the end position of the recording sheet floating prevention area 801-2 is set between the side end position WA4 of the A4-size recording sheet and the side end position WLTR of the letter-size recording sheet. That is, the recording sheet floating prevention member 801 includes the floating prevention area for each size of the recording sheet, and the end of each floating prevention area is set between the side end position of the recording sheet of the size being the target of the floating prevention and the side end position of the recording sheet of the size smaller than the above floating prevention target size by one.

By doing so, in the recording apparatus according to the present embodiment, since the recording sheet floating prevention areas 801-1 and 801-2 are provided, the floating of the frequently used A4-size recording sheet 802 and the letter-size recording sheet 803 on the non-reference side of the sheet can be prevented. Incidentally, in the recording apparatus according to the present invention, even if the recording is performed on another size of recording sheet, the floating of the recording sheet can be prevented by providing the recording sheet floating prevention member including the recording sheet floating prevention area along the side end position of this recording sheet.

(Second Embodiment)

Figure 9:
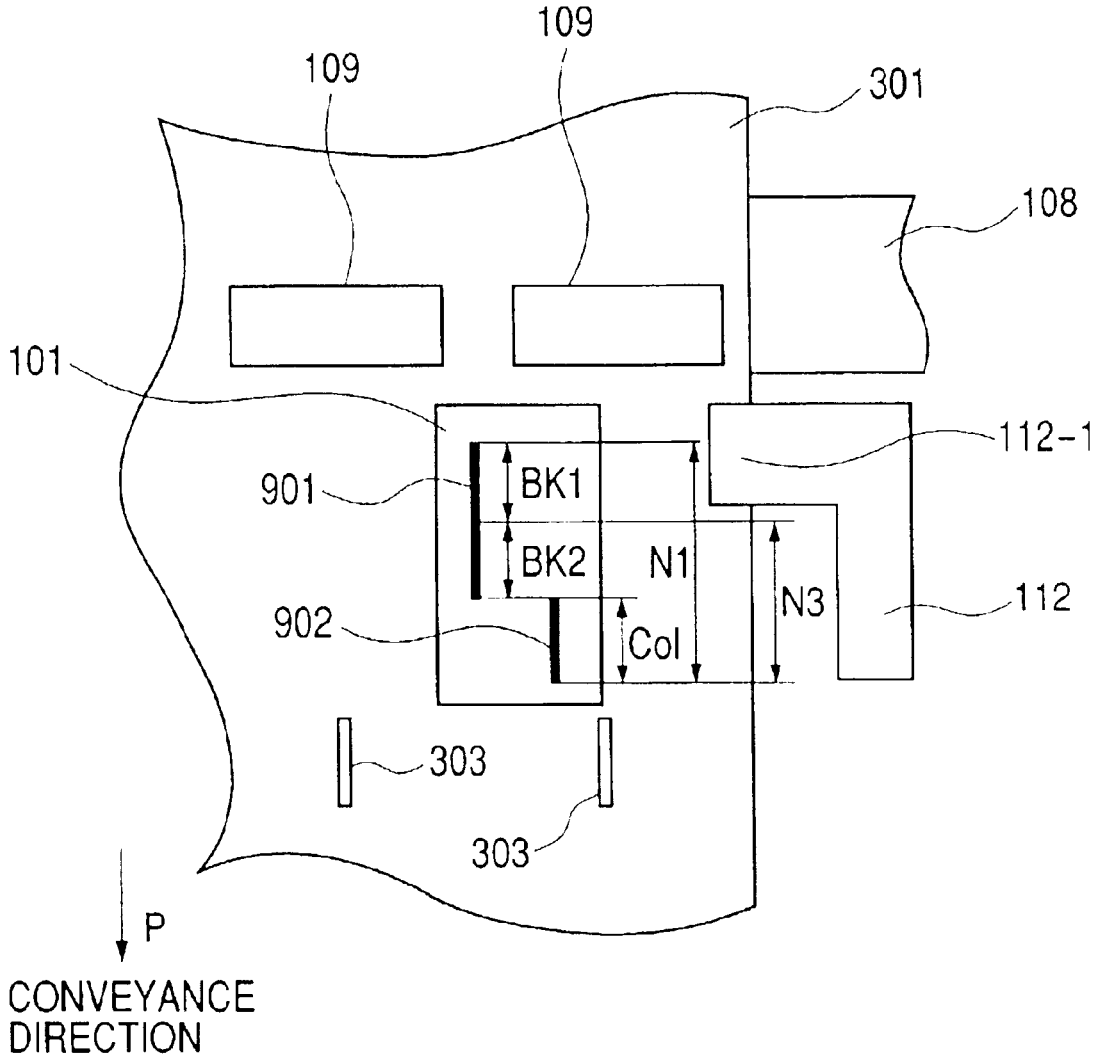
FIG. 9 is a view showing the relation of nozzle arrays and a sheet floating prevention member in a recording apparatus according to a second embodiment of the present invention.

Next, a recording apparatus according to a second embodiment of the present invention will be explained. FIG. 9 is a view showing the relation of nozzle arrays and a recording sheet floating prevention member in the recording apparatus according to the present embodiment. Here, it is assumed that, among the parts denoted by numerals and symbols used to explain the recording apparatus according to the present embodiment, the parts denoted by the numerals and the symbols being the same as those used to explain the recording apparatus according to the first embodiment respectively have the same elements, the same structures and the same functions as those of the parts in the first embodiment, as long as there is no particular description.

In the structure of the nozzle array of the recording head 101 in the recording apparatus according to the first embodiment shown in FIG. 4, the nozzle array 402 to discharge the color inks and the nozzle array 401 to discharge the black ink used in the non-margin recording are arranged in the single second area. On the other hand, in the recording apparatus according to the present embodiment, as shown in FIG. 9, the position of a nozzle array 901 (having a length BK1+BK2 in the conveyance direction) to discharge the black ink is set on the upstream side of the position of a nozzle array 902 (having a length Col in the conveyance direction) to discharge the color inks, and the:area for the non-margin recording nozzle array is provided as a third area (having a length N3 in the conveyance direction, given by N3=BK2+Col).

In the recording apparatus according to the present embodiment, it is desirable that the length BK2 (i.e., N3−Col) of the nozzle array used in the non-margin recording of the nozzle array 901 is equal to or longer than the length Col, and it is further desirable that a length BK1 (i.e., N1−N3) of the nozzle array usable only in the margin recording of the nozzle array 901 is equal to or longer than the length Col.

In this way, when the non-margin recording is performed, black recording by the nozzle array BK2 used in the non-margin recording of the nozzle array 901 can be performed on the line immediately before the recording by the nozzle array 902 of the color inks, whereby it is possible to achieve higher-quality non-margin recording to a recording sheet such as plain paper where a blur easily occurs. At the same time, when the margin recording is performed, the recording by the nozzle array BK1 used in the margin recording of the nozzle array 901 can be performed at one line before the last immediately before the recording by the nozzle array 902, whereby a higher-quality image can be obtained even if the recording sheet where a blur easily occurs is used.

Like the above, the area of the recording sheet floating prevention member 112 to hold down the margin is set on the upstream side of the third area, whereby the floating of the recording sheet can be surely held down. Besides, by doing so, the recording sheet floating prevention member 112 does not come into contact with the recording area, whereby it is possible to prevent the image quality deterioration after the recording.

In the recording apparatus according to the present embodiment, the downstream end of the nozzle array 901 to discharge the black ink in the conveyance direction P conforms to the upstream end of the nozzle array 902 to discharge the color inks in the conveyance direction P, but these ends need not necessarily conform. That is, the downstream end of the nozzle array 901 may be conformed to the downstream end of the nozzle array 902 or set on the further downstream side of the downstream end of the nozzle array 902.

Thus, when the non-margin recording is performed by the recording apparatus according to the present embodiment, the area where the recording is performed by the nozzle array 901 is provided on the upstream side of the nozzle array 902, whereby the higher-quality image can be obtained even if the recording sheet where the blur easily occurs is used. Moreover, the nozzle used for the margin recording is provided on the upstream side of the nozzle used for the non-margin recording, whereby it is possible to perform the recording by the long nozzle array in the conveyance direction P and maintain the recording speed. Moreover, the recording sheet floating prevention member 112 is arranged at the position substantially the same as the nozzle area used for the margin recording in the conveyance direction P of the recording sheet 301 and outside (margin) the nozzle area used for the margin recording in the carriage scan direction, whereby it is possible to prevent the collision of the recording sheet and the recording head, and the degradation of the image and breakage of the recording head after the recording.

Figure 10:
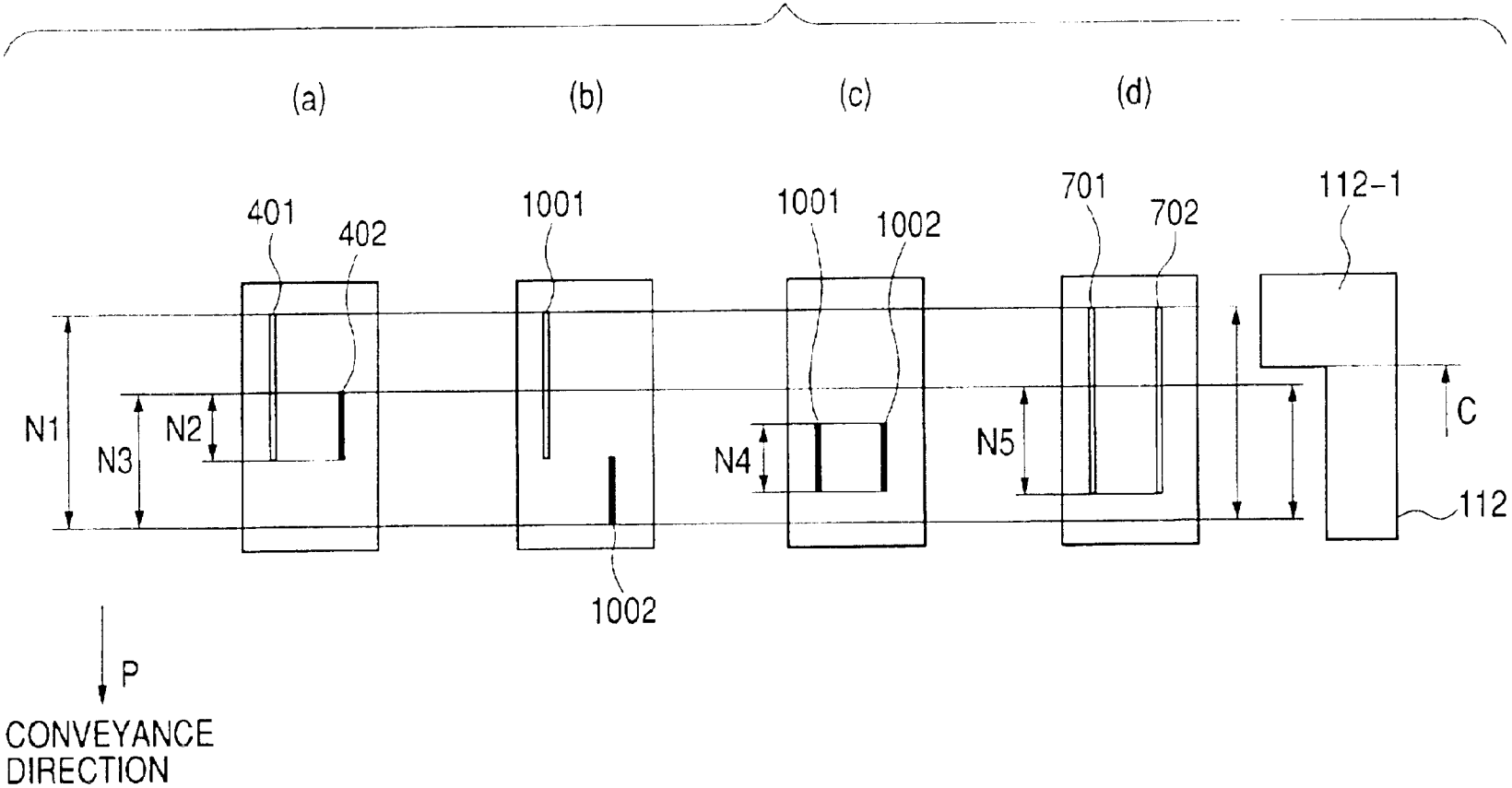
FIG. 10 is an elevation view showing the nozzle structure of the recording head applicable to the recording apparatus according to the present invention.

In the recording apparatus according to the present invention, as described in the first and second embodiments, if the nozzle structure of the recording head corresponds to the shape of the recording sheet floating prevention member, that is, if the nozzle used for the non-margin recording is arranged on the downstream side of the downstream end of the recording sheet floating prevention area of the recording sheet floating prevention member in the conveyance direction P of the recording sheet in the recording head, recording heads having various nozzle structures are applicable. FIG. 10 is an elevation view showing the nozzle structure of the recording head applicable to the recording apparatus according to the present invention. Here, (a) of FIG. 10 shows the nozzle structure of the recording head described in the first embodiment, and (b) of FIG. 10 shows the nozzle structure of the recording head described in the second embodiment.

As shown ini (a) and (b) of FIG. 10, as the upstream end of the first area (having the length N1) of the recording head in the first embodiment is conformed to the upstream end of the first area of the recording head in the second embodiment, if the upstream end of the second area of the nozzle array 401 of the recording head in the first embodiment is conformed to the upstream end of the third area of a nozzle array 1001 of the recording head in the second embodiment, the same recording sheet floating prevention member 112 can be applied as maintaining the relation N1−N2≧Col explained in the first embodiment, and the relation BK2≧Col, i.e., N3−Col≧Col, and the relation BK1≧Col, i.e., N1−N3≧Col, explained in the second embodiment. Here, although the upstream end position of the nozzle array used for the margin recording and the upstream end position of the nozzle array used for the non-margin recording are conformed, the same recording sheet floating prevention effect can be obtained as long as the nozzle area used for the non-margin recording is positioned on the downstream side of the downstream end C of the recording sheet floating prevention area 112-1 of the recording sheet floating prevention member 112 in the conveyance direction P.

Moreover, also in a case where the recording head where the length of the nozzle array to discharge the black ink is the same as the length of the nozzle array to discharge the color inks is adopted, all of the nozzle array 1001 to discharge the black ink and a nozzle array 1002 to discharge the color inks are arranged within the non-margin recording area (having a length N4) as shown in (c) of FIG. 10, or the nozzle array to discharge the ink in the non-margin recording is limited to the nozzle array arranged within the area of a length N5 among the nozzle array 701 to discharge the black ink and the nozzle array 702 to discharge the color inks as shown in (d) of FIG. 10, whereby the same recording sheet floating prevention member 112 can be applied.

As described above, the recording apparatus according to the present invention can be selectively equipped with the various recording heads respectively having different nozzle array arrangement patterns, whereby a degree of freedom can be provided to select the recording head. Moreover, the same recording sheet floating prevention members 112 and 801 provided in the recording apparatus according to the first embodiment can be provided also in the other recording apparatuses respectively having the various recording heads as shown in (a) to (d) of FIG. 10, whereby the recording sheet floating prevention effect according to the present invention can be obtained also in these recording apparatuses. That is, it is possible to standardize the recording sheet floating prevention member among the plural recording apparatuses and thus obtain the merits such as cost cutting and reduction of loads for development.

As described above, in the recording apparatus according to the embodiments, there is provided the recording sheet floating prevention means positioned between the recording sheet and the recording head and having the recording sheet floating prevention area overlapping the recording sheet only on the upstream side of the nozzle array used for the non-margin recording in the recording sheet conveyance direction, whereby it is possible to prevent the floating of the recording sheet in the non-margin recording and to avoid the collision of the recording sheet and the recording head.

Moreover, in the recording apparatus according to the embodiments, the nozzle array used for the margin recording is provided on the upstream side of the nozzle array used for the non-margin recording in the conveyance direction, and the recording sheet floating prevention area portion is provided in the recording sheet margin area outside the recording area of the nozzle array used for the margin recording in the carrier scan direction, whereby it is possible to prevent the floating of the recording sheet. Besides, since the length of the nozzle array in the margin recording can be elongated, it is possible to maintain the recording speed of the margin recording. In this case, by using the black nozzle for the margin recording and setting the black nozzle as the long nozzle array structure on the upstream side of the color nozzle, it is possible to reduce the blur between the black ink and the color inks that occurs in the margin recording and thus achieve higher-quality recording.

Moreover, the length of the nozzle array of the black ink used for the non-margin recording is set to be equal to or longer than the length of the nozzle array of the color inks used for the non-margin recording, and this nozzle array of the black ink is arranged so that it extends toward the upstream side in the conveyance direction, whereby it is possible to reduce the blur between the black ink and the color inks that occurs in the non-margin recording and thus achieve higher-quality recording.

Moreover, in the recording apparatus according to the embodiments, if the nozzle array used for the non-margin recording is arranged, in the recording head, on the downstream side of the downstream end of the recording sheet floating prevention portion of the recording sheet floating prevention member in the conveyance direction of the recording sheet, plural kinds of recording heads can be used, whereby it is possible to broaden options of the recording heads and thus provide the recording state with a high degree of freedom.

Moreover, the same recording sheet floating prevention member can be applied to the other recording apparatuses having the above recording head, whereby it is possible to standardize the recording sheet floating prevention member among these apparatuses and thus obtain the merits such as cost cutting and reduction of loads for development.

What is claimed is:

1. A recording apparatus which can be equipped with recording means for performing recording on a conveyed recording medium by discharging liquid from discharge opening arrays, comprising:

conveyance means for conveying the recording medium; and a recording medium floating prevention member for preventing floating of the recording medium, wherein said recording medium floating prevention member includes a floating prevention area between the recording medium and said recording means, only on an upstream side, with respect to the conveyance direction of the recording medium, of a discharge opening array of said recording means used in non-margin recording, in which recording is performed throughout the width of the recording medium, said recording means has a discharge opening array used in margin recording, in which recording is performed with margins remaining at side ends of the recording medium, on the upstream side, with respect to the conveyance direction, of the discharge opening array used in the non-margin recording, and the floating prevention area is arranged outside a recording area of the discharge opening array used in the margin recording and at a position adjacent the recording area of the discharge opening array used in the margin recording in a direction orthogonal to the conveyance direction.

2. A recording apparatus according to claim 1, wherein the discharge opening array used in the non-margin recording is included in the discharge opening array used in the margin recording.

3. A recording apparatus according to claim 1, wherein the discharge opening array used in the margin recording includes a black-ink discharge opening array to discharge black ink.

4. A recording apparatus according to claim 3, wherein the discharge opening array used in the non-margin recording includes a color-ink discharge opening array to discharge color inks, and the length of the black-ink discharge opening array used in the margin recording in the conveyance direction is equal to or longer than the length of the color-ink discharge opening array in the conveyance direction.

5. A recording apparatus according to claim 1, wherein a black-ink discharge opening array for discharging black ink and a color-ink discharge opening array for discharging color inks comprise discharge opening arrays used in the non-margin recording, wherein the black-ink discharge opening array is arranged on the upstream side of the color-ink discharge opening array.

6. A recording apparatus according to claim 5, wherein the length of the black-ink discharge opening array used in the non-margin recording in the conveyance direction is equal to or longer than the length of the color-ink discharge opening array used in the non-margin recording in the conveyance direction.

7. A recording apparatus according to claim 1, wherein said recording apparatus can be selectively equipped with the plural recording means respectively having different arrangement patterns of discharge opening arrays.

8. A recording apparatus according to claim 1, wherein said recording medium floating prevention member is integrally formed on a platen supporting the recording medium.

9. A recording medium floating prevention member which prevents floating of a recording medium, comprising:

a floating prevention area between the conveyed recording medium and recording means for performing recording on the recording medium by discharging liquid from discharge opening arrays, wherein said recording medium floating prevention member can be mounted on a recording apparatus so that said floating prevention area is positioned on an upstream side, with respect to the conveyance direction of the recording medium, of a discharge opening array of said recording means used in non-margin recording, in which recording is performed throughout the width of the recording medium, said recording means has a discharge opening array used in margin recording, in which the recording is performed with margins remaining at side ends of the recording medium, on the upstream side, with respect to the conveyance direction, of the discharge opening array used in the non-margin recording, and said floating prevention area is arranged outside a recording area of the discharge opening array used in the margin recording and at a position adjacent the recording area of the discharge opening array used in the margin recording in a direction orthogonal to the conveyance direction.

10. A recording apparatus which can be equipped with recording means for performing recording on a recording medium by discharging ink from a plurality of discharge openings, comprising:

conveyance means for conveying the recording medium;

holding means, provided downstream of said conveyance means with respect to a conveyance direction, for holding said recording means thereon;

a platen for guiding said recording means with a positional relation opposed to the recording means; and a restraining member, disposed at a predetermined position and opposed to a side end of the recording medium guided by said platen, for restraining the recording medium from separating from said platen, wherein the plurality of discharge openings comprises a group of non-margin recording discharge openings which can record on an area including a range extending to side ends of the recording medium, which area is downstream of said restraining member with respect to the conveyance direction and is not opposed to said restraining member, and margin recording, in which margins remain at side ends of the recording medium on an area of the recording medium opposed to said restraining member, can be conducted using discharge openings, of the plurality of discharge openings, that are further upstream than the group of non-margin recording discharge openings.

11. A recording apparatus according to claim 10, wherein the further upstream discharge openings are employed only for the margin recording.

12. A recording apparatus according to claim 10, wherein the discharge openings employed for the margin recording include discharge openings for discharging black ink.

13. A recording apparatus according to claim 12, wherein the discharge openings employed for the non-margin recording include discharge openings for discharging color ink, and the discharge openings for discharging black ink are distributed over a range longer than that of the discharge openings for discharging color ink.

14. A recording apparatus according to claim 10, wherein the group of non-margin recording discharge openings are also used when the margin recording is conducted.

15. A recording apparatus according to claim 14, wherein the further upstream discharge openings are employed only for the margin recording.

16. A recording apparatus according to claim 14, wherein the discharge openings employed for the margin recording include discharge openings for discharging black ink.

17. A recording apparatus according to claim 16, wherein the discharge openings employed for the non-margin recording include discharge openings for discharging color ink, and the discharge openings for discharging black ink are distributed over a range longer than that of the discharge openings for discharging color ink.

* * * * *

UNITED STATES PATENT AND TRADEMARK OFFICE

CERTIFICATE OF CORRECTION

PATENT NO. : 6,869,176 B2
DATED : March 22, 2005
INVENTOR(S) : Saito

It is certified that error appears in the above-identified patent and that said Letters Patent is hereby corrected as shown below:

Title page,
Item [56], References Cited, FOREIGN PATENT DOCUMENTS,
"JP 2001347692 A
JP 2002036649 A" should read
-- JP 2001-347692 A
JP 2002-36649 A --.

Column 1,
Line 32, "because,." should read -- because, --.

Column 6,
Line 29, "posit-ion" should read -- position --.

Column 8,
Line 64, "the:area" should read -- the area --.

Column 10,
Line 9, "ini" should read -- in --.

Signed and Sealed this

Thirteenth Day of December, 2005

JON W. DUDAS
*Director of the United States Patent and Trademark Office*